United States Patent [19]

Marco

[11] 4,420,507

[45] Dec. 13, 1983

[54] PROCESS FOR IMPROVING OPACITY OF POLYESTER TEXTILE MATERIALS

[75] Inventor: Francis W. Marco, Pauline, S.C.

[73] Assignee: Milliken Research Corporation, Spartanburg, S.C.

[21] Appl. No.: 215,193

[22] Filed: Dec. 10, 1980

Related U.S. Application Data

[60] Division of Ser. No. 128,619, Mar. 10, 1980, Pat. No. 4,283,452, which is a continuation-in-part of Ser. No. 72,959, Sep. 6, 1979, abandoned, which is a continuation-in-part of Ser. No. 40,032, May 17, 1979, abandoned.

[51] Int. Cl.[3] ..... B05D 5/00; D06C 29/00

[52] U.S. Cl. ..... 427/170; 427/372.2; 428/386; 428/480

[58] Field of Search ..... 427/372.2, 394, 371.2, 427/170, 322, 444; 428/206, 220, 240, 245, 253, 288, 265, 272, 290, 480, 539, 323; 8/115.6, 179, DIG. 4; 260/40 P, 42.19; 106/300; 524/315, 361, 376

[56] References Cited

U.S. PATENT DOCUMENTS

| | | | |
|---|---|---|---|
| 2,232,168 | 2/1941 | Dawson | 106/300 |
| 2,309,964 | 2/1943 | Landolt | 427/170 |
| 2,868,663 | 1/1959 | Jarmus et al. | 106/300 |
| 3,043,740 | 7/1962 | Freud et al. | 106/300 |
| 3,382,086 | 5/1968 | Singleton | 427/365 |
| 3,770,478 | 11/1973 | Bishop | 428/480 |
| 3,867,332 | 2/1975 | Chimura et al. | 260/40 P |
| 3,924,046 | 12/1975 | Ribka et al. | 428/265 |
| 3,953,622 | 4/1976 | Wismer | 427/170 |
| 4,190,689 | 2/1980 | Fujita et al. | 428/206 |

FOREIGN PATENT DOCUMENTS

| | | | |
|---|---|---|---|
| 880847 | 9/1971 | Canada | 428/265 |
| 47-24174 | 7/1972 | Japan | 260/40 P |

*Primary Examiner*—S. L. Childs

*Attorney, Agent, or Firm*—H. William Petry; Terry T. Moyer

[57] ABSTRACT

According to the process by which the textile material is made, the titanium dioxide pigment having a particle size of at least about 0.18 micron is exhausted from a dispersion of same onto the textile material at a pH below approximately 7.5. Subsequent heat setting of the polyester textile material improves retention of the titanium dioxide pigment.

16 Claims, 8 Drawing Figures

PROCESS FOR IMPROVING OPACITY OF POLYESTER TEXTILE MATERIALS

This application is a divisional application of copending patent application, U.S. Ser. No. 128,619, filed Mar. 10, 1980, now U.S. Pat. No. 4,283,452, which in turn is a Continuation-in-Part of copending patent application, U.S. Ser. No. 072,959, filed Sept. 6, 1979 now abandoned, which is in turn a Continuation-in-Part of copending patent application, U.S. Ser. No. 40,032, filed May 17, 1979, now abandoned.

It has long been known that textile materials, that is spun yarns, extruded filaments, woven fabrics, knitted fabrics, non-woven materials and the like can be rendered more opaque by the addition of various metal oxides, such as titanium dioxide thereto. By adding opacity to a sheer textile material, the covering power of the material is greatly improved, without the extra weight and cost that would be present for a heavier, tightly formed substrate. Likewise, in so adding opacity to the textile material it is quite desirable, if not imperative, to avoid changing the handle characteristics to a point where the material becomes unsuited for garment use, for example, and the improved opacity characteristic should be retained after repeated launderings or dry cleanings.

Titanium dioxide is a suitable material for adding opacity to a textile material. Titanium dioxide addition to a synthetic polymeric filament has often been made by adding same to the polymer melt prior to extrusion of the filaments. Such techniques result in dispersion of the titanium dioxide throughout the filament cross section. Textile fabrics, spun yarns, non-woven webs, extruded filaments and the like, have been treated after formation wherein the titanium dioxide has been applied to the surface of textile materials from pad baths, by spraying, by dipping and the like for various effects, including opacity. In particular, in those instances where the titanium dioxide has heretofore been utilized to add whiteness or opacity to the textile material, an adhesive binder has been included as the primary means for securing same to the textile material for durability purposes both as to "dusting", i.e., removal of the pigment due to surface distortion, and repeated laundering and dry cleaning operations. Generally, however, when a sufficient amount of titanium dioxide is added to appreciably improve opacity of the substrate, the amount of binder previously required has produced a quite stiff substrate. In padding operations, the titanium dioxide also migrates during drying, presenting non-uniform distribution of pigment on the surface of the substrate.

Adhesive binders, and titanium dioxide, either in the form of a titanium salt or a pigment, have heretofore been present in dispersions, solutions or emulsions along with other ingredients and brought into contact with the textile material for normal application thereto. The textile material was thereafter further processed to promote adherence of the various ingredients thereto.

It has further been known to utilize titanium salts in dispersions that are applied to textile materials, such as cellulose acetate, rayon and the like to deluster same. Application of the metal oxides to deluster a cellulosic substrate has conventionally utilized a metal salt in the dispersion with the salt thereafter being acid treated to release the metal ions which become affixed to the substrate under acidic conditions. In fact, such processes have historically been operated totally under acid conditions. Other techniques have likewise been utilized for applying titanium dioxide onto textile materials. Exhaustion techniques have been practiced, where the particle size of the titanium dioxide was 0.1 micron or smaller. In such processes, the titanium dioxide is of such particle size as to be colorless and is applied to resist soiling of the textile material without any whitening effect. In other words, opacity is not improved.

While all of the above techniques have in fact been previously utilized to apply titanium dioxide and other metal oxides onto textile substrates, no one or combination of same has approached the problem of the present invention, i.e., providing an improved polyester fiber-containing textile material which has been rendered more opaque to the passage of light wherein the material added to improve the opacity is bound to the substrate without the necessity of an adhesive binder as the primary means for bonding the particles to the surface of the textile material, and yet is quite durable to repeated laundering and dry cleaning operations, and compatible with other textile finishing operations. Very importantly, relatively large amounts of pigment may be added to the textile substrate without a resultant harsh handle.

It is an object of the present invention to provide a polyester fiber-containing textile material having improved opacity and to provide a process for preparing same.

Another object of the present invention is to provide improved polyester fiber-containing textile materials which are more opaque to the transmission of light and which have good handle characteristics and to provide a process for preparing same.

Still another object of the present invention is to provide a process for the adhesion of titanium dioxide to a polyester textile material from a bath in the absence of a binder as the primary means of adhesion and to provide products of such processes.

Yet another object of the present invention is to provide an improved process for exhaustion of titanium dioxide onto a polyester textile material to improve opacity of the material without adversely affecting handle of the material and to provide improved products produced thereby.

A further object of the present invention is to provide a polyester fiber-containing textile material which not only has improved opacity characteristics on a per unit titanium dioxide add-on basis as compared to known products but which also is easier to clean and which "hides" the presence of soil on the fabric.

Generally speaking, the present invention relates to polyester fiber-containing textile material having improved opacity and handle characteristics, which comprises a polyester fiber-containing substrate; said textile fibers having been covered with titanium dioxide particles having an average particle size of at least about 0.18 micron in an amount of up to about 20 percent by weight, the durability of bonding of said particles to said textile fibers in the absence of a binder as the primary bonding means being such that at least about 50 percent of said particles remain bound to the surface of said textile fibers after five standard washings according to the standards set by the American Association of Textile Chemists and Colorists (herein AATCC). Furthermore, according to the invention and as can be observed in the attached photographs the particles will be disposed on the textile material so as not to form a substantial number of agglomerates of the particles between the textile fibers.

The present invention also relates to an improved process for rendering a polyester fiber-containing textile material more opaque comprising the steps of providing an aqueous dispersion of titanium dioxide pigment having a particle size of at least about 0.18 micron; contacting said textile material with said aqueous dispersion under agitation conditions and at a pH below approximately 7.5 whereby said pigment exhausts from said dispersion onto said textile material, and thereafter heat setting the textile material.

Figure 1:
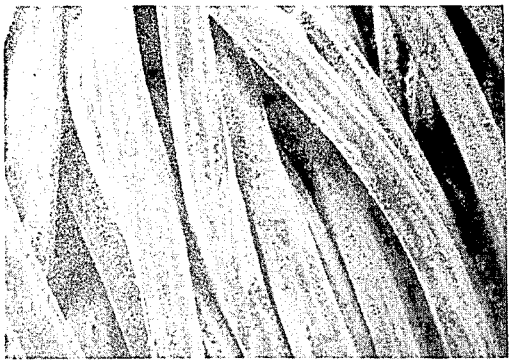
FIGS. 1–3 are micrographs taken of products made according to the invention under laboratory conditions at magnifications of 470X, 950X, and 1900X.

The polyester fiber-containing textile material of the present invention may be in a yarn or filament form, a woven or knitted fabric form, a non-woven form or the like. The textile material may contain at least about 10 percent by weight, preferably at least about 40 percent by weight, polyester fibers. All polyester textile materials, especially 100 percent textured polyester, have been found to be particularly suitable as textile substrates in the products of the present invention.

The titanium dioxide particles of the present invention may be in pigment form, may be of either rutile or anatase crystalline structure and may have alumina or silica coatings thereon. The thrust of the present invention is, of course, to provide a polyester textile material having improved opacity. As such, the particle size of the titanium dioxide pigment should be at least about 0.18 micron, whereby improved covering power of the textile material is likewise realized coincident with the opacity characteristic. Hence, the titanium dioxide suitable for use according to the present invention must be of sufficient particle size to create a whitening effect on the textile material. Up to about 7 percent titanium dioxide particles based on the textile material weight may be provided on the textile material without any substantial "dusting" and with good durability to laundering and dry cleaning, even in the absence of even a minor amount of an extraneous adhesive binder. Amounts of titanium dioxide ranging up to about 20 percent based on the weight of the material may be provided with only slight "dusting" in the total absence of an adhesive binder; and where it is desired to provide such larger amounts of pigment, a minor amount of binder, e.g., about 2 percent or less by weight, may be applied as a secondary bonding means to minimize or eliminate "dusting" and to further improve the durability to laundering and dry cleaning.

The process of the present invention is preferably directed to dispersing titanium dioxide pigment in an aqueous medium having a basic pH whereby the dispersion remains stable in the absence of agitation. The polyester fiber-containing textile material is contacted by the aqueous dispersion with relative agitation between the dispersion and the textile material. After the textile material is in the dispersion under agitation conditions, pH of the dispersion is gradually reduced to a level below approximately 7.5 at which point the pigment begins to exhaust from the dispersion onto the textile material. Completion of exhaustion of the pigment from the bath is evidenced by clarification of the bath.

While in the preferred process embodiment the pH of the dispersion may be gradually reduced by any means exemplified by controlled addition of acid or the in situ generation of acid, preferably an acid generating compound is added to the dispersion which requires some extrinsic means for generation of the acid. Utilization of acid generating compounds permits a safer operation with better control of pH reduction of the bath. In a most preferred situation, an acid generating substance, such as butyrolactone, is included in the dispersion which, when heated generates acid and gradually lowers pH of the dispersion.

In a most preferred embodiment, titanium dioxide pigment having a particle size of approximately 0.2 micron is dispersed in an aqueous medium with an alkali to achieve approximately 5 percent titanium dioxide based on weight of the textile material and a bath pH of approximately 9. The textile material is then contacted with the dispersion under continuous relative agitation conditions and butyrolactone, dyestuff and dye auxiliaries are added to the bath. Temperature of the bath is then gradually raised at a rate of approximately 3° F. per minute to approximately 266° F. with pH of the dispersion being gradually reduced to about 4.7. As the acid is produced and pH is lowered below about 7.5, the titanium dioxide begins to exhaust onto the textile material. Upon reaching a pH of 4.7 and a bath temperature of 266° F., the dispersion becomes clear, indicating almost complete exhaustion of titanium dioxide therefrom. The textile material having the titanium dioxide thereon is then removed from the bath, rinsed, dried and heat set. The titanium dioxide, for all practical purposes, is durably bonded to the textile material, even in the absence of an extraneous adhesive binder as the primary bonding means. The textile material is thus rendered more opaque at an approximate pick up of, for instance, 5 percent by weight titanium dioxide, with little change to the handle of the fabric. The textile material may then be further processed to render same soil resistant, crease resistant, or the like without any adverse change to the durability of the titanium dioxide thereon. It will also be apparent that although no extraneous adhesive binders are required to provide a durable bond, minor amounts, e.g., about 2 percent or less by weight of an extraneous adhesive binder may be applied to the material to further enhance the durability of bonding of the particles to the textile substrate. Generally, however, even where an adhesive binder is applied the amount required will be minor so that the handle of the material may not be so adversely affected as to render the material undesirable for its intended applications.

The polyester fiber-containing textile material of the present process may be characterized as approximately twice as opaque as untreated controls. For example, utilizing a Hunter Color Difference Meter, samples are measured for reflection (L value) over both a white and a black background, and then opacity is expressed as the difference in L values ($\Delta L$). A completely transparent sample exhibits a $\Delta L$ value of 100 while a totally opaque sample exhibits a $\Delta L$ value of 0. Hence, polyester fiber-containing materials treated by the present process exhibit approximately one half the ΔL as that of the untreated control. Because the titanium dioxide particles are bonded to the material surface in the absence of a binder as the primary bonding means, improved opacity is accomplished without adversely affecting the handle characteristics of the material.

In general, it has been determined that the titanium dioxide particles of the textile material product of the present invention will coat from about 2 percent to about 80 percent, preferably about 10 percent to about 40 percent, of the surface of the textile material. Coating may be determined quantitatively based upon examination of electron micrographs of a textile material. If no particles are bound to the surface and the surface is substantially free of pigment particles the extent of coating is 0. If the textile material is completely covered with particles and no fiber substrate is visible on an electron micrograph the extent of coating is 100 percent, although as a practical matter such a high level of coating would probably not be required in a textile material product. Similarly, if about half of the fiber substrate is visible on a micrograph the extent of coating is 50 percent, and so forth.

Figure 2:
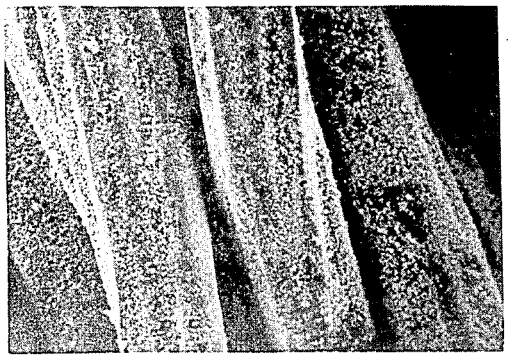
Figure 4:
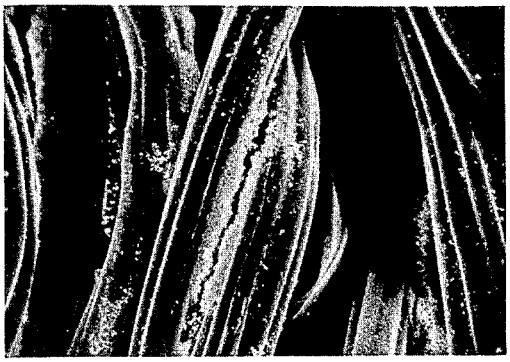
FIG. 4 illustrates a product made according to a prior art padding technique at approximately the same magnification as FIG. 1.
Figure 3:
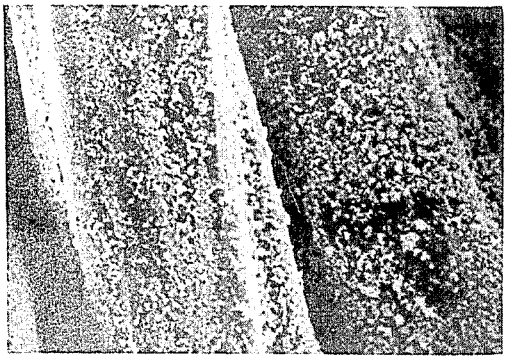
Figure 5:
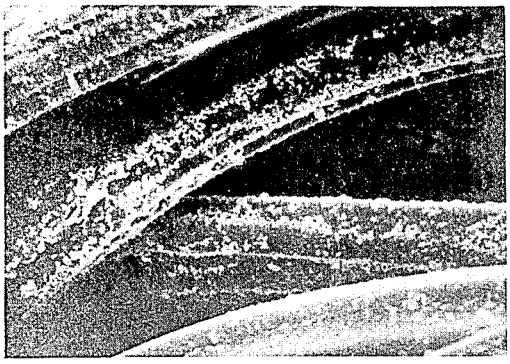
FIGS. 5–6 are micrographs of products of the invention made in production conditions at magnifications of 950X and 1900X.
Figure 6:
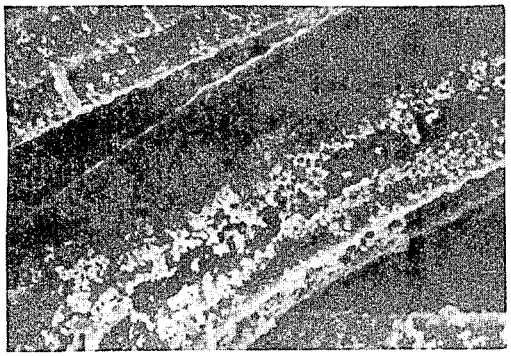
Figure 7:
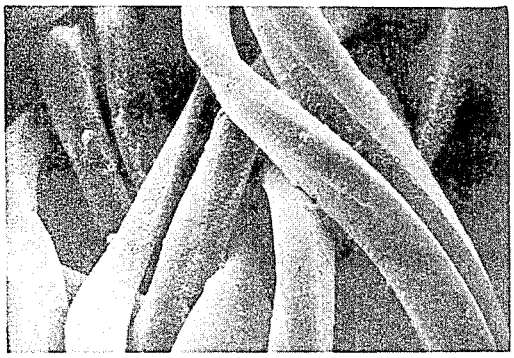
FIGS. 7–8 are micrographs of products of the invention which have been subsequently finished at magnifications of 450X and 1900X.
Figure 8:
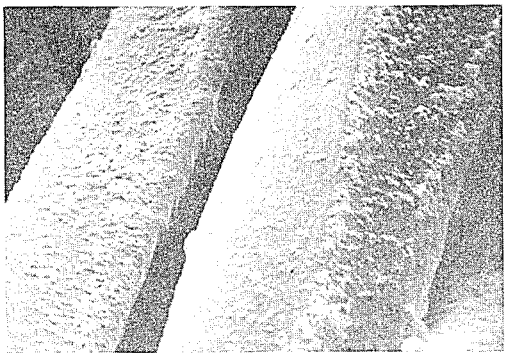

Generally, the products of the present invention exhibit substantially improved cover as compared to prior art products based upon the same amount of titanium dioxide by weight, provided on the surface of the product. This improvement, which is quite surprising, is achieved, it is thought, because the pigment particles are in general much more evenly distributed on the surface of the textile material of the present invention than in known textile products. While this even distribution is difficult to quantify or even describe verbally it is quite apparent visually as can be seen by the side by side comparison provided in the attached micrographs. Thus, FIGS. 1–3 illustrate magnifications of the products of the present invention of 470X, 950X and 1900X using the process and employing the same materials set forth in Example 1 except that the pigment was Titanox 1070 manufactured by NL Industries. The even distribution of the particles on the surface of the textile material is quite apparent and is even more apparent when compared with FIG. 4 which illustrates the prior art padding technique using the same pigment with about 5 percent titanium dioxide applied based on the weight of the fabric. The pigment was padded on, dried and cured. FIG. 4 which is approximately the same magnification as FIG. 1 shows that there has been a substantial amount of agglomeration of the particles, and this agglomeration is particularly apparent at the interfaces of the fibers with one another. By contrast in FIGS. 1 to 3, agglomeration of the particles has been minimized, with the average agglomerate size being less than about 25 primary particles. While FIGS. 1 to 3 are illustrations of products made in the laboratory under ideal conditions (as in the product illustrated in FIG. 4) even in production conditions agglomeration of the particles on the surface of the products of the invention (illustrated in FIGS. 5 and 6 at magnifications of 950X and 1900X) is certainly minimized, with average agglomerate sizes being generally less than about 50 primary particles per agglomerate although somewhat higher average agglomerate sizes may be observed in certain applications. Also, the average agglomerate size may vary depending upon the definition of what constitutes an agglomerate. In any event, it is thought that the "minimization of agglomeration" feature of the present invention is very apparent based upon visual observation of the attached micrographs. Minimization of agglomeration, furthermore, remains as a characteristic of the product even after subsequent finishing as illustrated in FIGS. 7 and 8 at magnifications of 450X and 1900X.

In addition to the improved cover, opacity, and handle characteristics of the products of the present invention, perhaps most importantly it has been observed that the titanium dioxide particles of the present invention are very durably bonded to the surface even in the absence of a binder as the primary bonding means, although minor amounts of an extraneous adhesive binder may be present in the product as a secondary bonding means where desired. Applicant has not been able to determine precisely how such advantageously durable bonding is accomplished, it being sufficient to state that the particles are adhered durably to the surface of the textile material. Thus, the bond that is formed is durable in the absence of a binder as the primary bonding means; and this durability characteristic may be measured by subjecting the textile products to standard AATCC washings. This standard AATCC washing is described in Method 130, Procedure 2, of the Technical Manual of the American Association of Textile Chemists and Colorists, Vol. 53, p. 253 (1978 ed.), and will be well-known to those skilled in the textile arts. While it will be appreciated that durability of bonding will depend upon such factors as the amount of $TiO_2$ initially applied, method of application, substrate composition, and the presence on the material of binders and other additives, generally, the products of the present invention may be characterized in that at least about 50 percent, preferably about 70 percent or more by weight, of the titanium dioxide particles remain bound to the surface of the textile fibers after five standard AATCC washings. In certain preferred applications the durability of bonding may be even greater, e.g., about 80 percent or even greater after five AATCC washings.

The textile material products of the present invention may be further characterized by certain additional advantageous properties in a textile product. For instance, the products generally exhibit improved "flat dry" characteristics as compared to known products where a binder is generally employed as the primary means of bonding the particles to the textile material. The products of the present invention also exhibit improved moisture wicking properties as compared to known products. The soil release characteristics of the products of the present invention are also significantly improved by application of any of the known soil release agents as compared to known products of the same type where a binder has been employed since the properties of most or all known binders in general are disadvantageous from a soil release standpoint.

Preferred embodiments of the process of the present invention will now be described in detail. In the context of the present invention, polyester fiber-containing textile materials that may be treated to provide a product having improved opacity may be a spun yarn, an extruded filament, a woven fabric, a knitted fabric, an unwoven web, or the like. Obviously, in the sense of strands such as spun yarns or extruded filaments, opacity will be apparent per se and will carry forward to a substrate formed therefrom, e.g., by weaving, knitting, non-woven techniques or the like. Extruded filaments per se or in fabric or web form may have a round cross section, or preferably, may possess a non-round cross section such as multilobal, and are preferably texturized.

The terms "textured" and "texturized" are used herein interchangeably to refer to an otherwise smooth, continuous filamentary yarn which has been crimped, looped, coiled, or crinkled by any one of at least a dozen well-known techniques to impart improved properties thereto, such as stretch, luxurious bulk, greater absorbency and/or improved hand. The most preferred texturized yarns of the invention are those made by false twisting of the yarn on any of the well-known and used false-twist type stretch yarn machines, such as those made by ARCT, Barmag, Berliner, Davide, Guidici and others. Among the many advantages of fabrics made from texturized yarns, particularly polyester yarns, are that they simulate some of the characteristics of fabrics made from spun yarns and provide certain additional advantageous characteristics such as improved pill and crease resistance, better shape retention, greater durability and more uniform appearance.

In the context of the present invention, the term polyester fiber means any polymeric ester that has been extruded into filamentary form. Conventionally, the polyester is the reaction product of a dicarboxylic acid, or ester forming derivative of same and a glycol, e.g., dimethyl terephthalate and ethylene glycol that is condensed to provide a polymer of the glycol ester of the dicarboxylic acid. Such polyester may also contain other constituents to render the filaments extruded therefrom capable of basic dyeability, to impart antistatic properties, flame retardant properties or the like.

In applying the titanium dioxide, which as indicated above should have an average particle size of at least about 0.18 micron, a good dispersion can be attained under alkaline conditions, which will remain stable for prolonged periods of time. As the pH of the dispersion is changed to the acid side, the titanium dioxide begins to exhaust therefrom. Gradual lowering of the pH of the dispersion achieves a quite uniform application of titanium dioxide onto the textile material. In fact, it was totally surprising to determine that relatively large amounts of titanium dioxide can be exhausted onto the textile material by the present techniques while retaining a good material handle for garment end use. Likewise, it was surprising to determine that the pigment is durable to repeated laundering and dry cleaning without the use of adhesive binders as the primary means for bonding the particles to the surface of the textile material.

When an initial dispersion has an acid pH, agitation is required to maintain proper dispersion stability. Likewise, uniformity of deposition of the titanium dioxide pigment appears less than when the initial dispersion has a basic pH.

While not wishing to be bound by any particular theory, it is hypothecated that the titanium dioxide pigment begins to exhaust from the dispersion at its isoelectric point where the electrical charge on the titanium dioxide particles changes from negative to positive. In any event, when the pH of the dispersion becomes about 7.5 or below, exhaustion commences. A gradual reduction of pH of the dispersion permits the pigment to adhere to the textile material as it exhausts from the dispersion with little or no pigment precipitation from the bath. Too rapid a reduction of pH interferes with uniform application of pigment onto the substrate and tends to destroy stability of the dispersion.

A proper dispersion of titanium dioxide pigment in water may be obtained by any suitable procedure. For example, for the preferred embodiment the pigment may be predispersed in a dilute alkaline solution, or may be added directly to the alkaline aqueous medium. Suitable alkaline materials include without limitation, ammonium hydroxide, sodium hydroxide and the like. Thereafter, stirring will disperse the pigment in the medium as evidenced by a milky appearance, and the dispersion will remain stable. According to the present invention, the amount of titanium dioxide pigment in the dispersion may be in a range of from about 1.0 to about 20 weight percent based on the weight of textile material to be treated, and preferably about 3 to about 7 percent. Up to 7 percent titanium dioxide based on material weight has been added to a textile material without "dusting" and with good durability to laundering and dry cleaning. In like vein, amounts of about 20 percent based on material weight have been added with only slight "dusting."

During operation of the present process, it is most desirable to maintain continuous relative movement between the dispersion and the textile material. Such may be accomplished by continuous agitation of the dispersion or movement of the textile material, or both. Since, as mentioned hereinafter, the present process is compatible with dyeing operations, the process may be conducted in commercial dyeing apparatus such as a jet rope dyeing apparatus where the textile material is handled in rope form, agitated by a jet of water or the like.

Once the substrate is in contact with the dispersion, the pH can then be lowered to promote the exhaustion. While any technique may be employed for lowering the pH of the dispersion, as mentioned above, the drop should be gradual. An acid, e.g., acetic acid, may be slowly added to the dispersion to lower the pH. At a pH above 4, it is preferable to heat the dispersion for complete exhaustion, while at a pH of 4 or below complete exhaustion of the titanium dioxide will occur at ambient temperature.

A preferred technique, however, for adjustment of the dispersion pH is the addition of an acid generating compound which, when subjected to a predetermined condition, such as the application of heat, will liberate an acid which in turn lowers the pH of the dispersion. Butyrolactone, a compound marketed under the name SANDACID V by Sandoz Chemical Company is a preferred acid generating compound. Temperature increase is controlled to limit acid generation and, therefore, achieve the gradual pH reduction.

Though no ingredients are essential to operation of the present process other than those to disperse titanium dioxide in an aqueous medium and a means for adjusting pH of the dispersion, other ingredients may be included in the dispersion so long as they do not adversely affect exhaustion of the titanium dioxide, handle of the material for its intended use, durability of the treatment, or the like. Without limitation, such further ingredients which may or may not be present in sizable quantities include dyestuffs, dyestuff carriers, levelers, lubricants, chelating agents, optical brighteners, binders in a minor amount, and the like. In like fashion, after improving the opacity or cover of a textile material according to the process of the present invention, the textile material may thereafter be treated to impart crease resistant properties, soil resistant properties, fire retardant properties, and the like thereto. In fact, the present process may be conducted simultaneously with a soil release or soil resistant treatment, though same is not preferred.

In general, whether the initial dispersion is alkaline or acid, exhaustion of the titanium dioxide occurs at a pH below about 7.5. As mentioned above, a preferred process utilizes an initially alkaline dispersion with the pH of same being gradually reduced to the acid side. Such produces a very uniform deposition of titanium dioxide on the substrate. Preferably, whether initially alkaline or acid, pH of the dispersion during exhaustion falls in a range of from about 6 to about 3, with a most preferred range being from about 5 to about 4.

While the titanium dioxide applied to the polyester textile material is durable without other ingredients, subsequent applications of crease resistant chemicals, soil resistant chemicals, or, as mentioned above a minor amount of an extraneous adhesive binder and the like, will add further durability. Likewise, the polyester textile material may be heat set after the titanium dioxide is added to further enhance durability. Heat setting, for example, will cause a substantially greater amount of titanium dioxide to be retained on the substrate after repeated washings and dry cleanings. Normally the heat setting is conducted by subjecting the material to temperature in a range of from about 300° to about 400° F. for a residence time of from about 5 seconds to about 1 minutes. As mentioned above, while an extraneous adhesive binder is ordinarily not required to provide a product having good durability, a minor amount, e.g., about 2 percent or less by weight of an adhesive binder, may be applied to the material where desired.

The process according to teachings of the present invention may be better understood by reference to the following examples.

EXAMPLE 1

A length of 100 percent texturized polyester fabric was placed in a Mathis laboratory dyeing apparatus, type JF. Water was then introduced into the dyeing apparatus at a temperature of 80° F. adequate to provide a bath to fabric weight ratio of 30:1, and agitation started. Titanium dioxide pigment (TI-Pure 960 manufactured by DuPont) was predispersed in a dilute ammonium hydroxide solution in a Waring blender for five minutes. Thereafter, the titanium dioxide-ammonium hydroxide dispersion was added to the aqueous bath in the dyeing apparatus to an amount of pigment representing 5 percent of the weight of fabric, and pH of the bath was 9.0. After agitation for five further minutes, butyrolactone (SANDACID V manufactured by Sandoz Chemical Company) was added to the dispersion in an amount of 3 percent based on fabric weight. Temperature of the dispersion was then raised at a rate of 3° F. per minute to a temperature of 266° F. The 266° F. temperature was held for five minutes after which the bath was cooled to 160° F. Bath pH then measured 4.7, and exhibited clarity, indicating exhaustion of the pigment. The fabric was then removed from the bath, rinsed once, dried and heat set at a temperature of 350° F. for one minute. The processed fabric exhibited greatly improved opacity when compared to a control fabric that was processed in like fashion without the presence of the titanium dioxide pigment. Weight analysis indicated that 95 percent of the titanium dioxide had exhausted from the dispersion onto the fabric. Improved opacity remained after repeated laundering and dry cleaning, evidencing durability. About 70 percent of the titanium dioxide particles remained after 5 AATCC washings.

EXAMPLE 2

A length of 100 percent texturized polyester fabric was placed in a beaker of cold water with a water to fabric ratio of 30:1 and agitated. Ammonium hydroxide was then added to the bath adequate to bring the pH of the bath to 10.0. Titanium dioxide pigment was then added to the bath in an amount equivalent to 7 percent based on weight of the fabric (particle size 0.22 micron). Agitation was continued for five minutes after which pH of the bath was adjusted to 4.0 with the prolonged gradual addition of acetic acid. Temperature of the bath was then gradually raised to 212° F. At a temperature of approximately 158° F., appreciable exhaustion of the titanium dioxide pigment was noted. After fifteen minutes at 212° F., the bath was clear indicating almost complete exhaustion of the titanium dioxide. The fabric was removed from the bath, dried and cured at a temperature of 360° F. for 30 seconds and weighed whereupon it was determined that 95 percent of the titanium dioxide pigment had exhausted onto the fabric. The fabric exhibited improved opacity which was durable to both laundering and dry cleaning. Virtually no "dusting" was noted, and a good fabric handle was apparent. About 70 percent of the titanium dioxide particles remained after 5 AATCC washings.

EXAMPLE 3

The procedure of Example 2 was repeated with the exception that temperature of the bath was maintained at ambient conditions. Again, virtually all the titanium dioxide exhausted onto the textile fabric, and improved, durable opacity resulted, though a longer period of time was required for complete exhaustion. About 60 percent of the titanium dioxide particles remained after 5 AATCC washings.

EXAMPLE 4

Textured polyester fabric was processed as described in Example 1. The processed sample was then evaluated along with an untreated control to determine the initial opacity of same and durability of opacity after repeated washing at 120° F. for five minutes. Opacity was determined with a Hunter Color Difference Meter as discussed above. The value for ΔL indicates the degree of opacity ranging from 0 the total opacity to 100 for complete transparency. Results are set forth in Table I.

TABLE I

OPACITY OF TEXTURED POLYESTER FABRICS

| | Untreated Control | $TiO_2$ on Fabric, Heat Set |
|---|---|---|
| Initial Opacity, ΔL | 14.2 | 5.8 |
| After 1 Wash, ΔL | 14.0 | 6.7 |
| After 5 Washes, ΔL | 14.0 | 6.8 |
| After 10 Washes, ΔL | 13.9 | 7.0 |
| After 20 Washes, ΔL | 13.9 | 7.0 |
| After 50 Washes, ΔL | 13.9 | 7.3 |

EXAMPLE 5

Fabric samples processed as set forth in Example 1, certain of which were not heat set, were subjected to up to 5 home laundering operations, during which titanium dioxide count was intermittently checked to further determine the durability of the titanium dioxide on the substrate. Results are indicated in Table II.

TABLE II

| Sample | Initial | $TiO_2$ Count After 1 Wash | After 5 Washes |
|---|---|---|---|
| Heat Set | 684 | 542 | 420 |
| Not Heat Set | 765 | 282 | 177 |

Titanium dioxide count indicates the amount of titanium dioxide on the substrate and is a measure of intensity, corrected for background in counts per second determined by x-ray fluorescence. It is thus noted that durability is enhanced by heat setting, and with heat setting, appreciable amounts of titanium dioxide remain after repeated washings.

EXAMPLE 6

Texturized 100 percent polyester was processed as described in Example 1 with the exception that the fabric was only dried and was not heat set. Thereafter, the fabric with the titanium dioxide thereon was padded with an emulsion containing a copolymer of methyl acrylate: acrylic acid (70:30) to provide 0.3 percent copolymer solids based on fabric weight. The fabric was then dried and heat set at 350° F. for one minute. Good durable cover was found to be present for the fabric along with good soil release properties. About 70 percent of the titanium dioxide particles remained after 5 AATCC washings.

EXAMPLE 7

Example 1 was repeated with the exception that a pink dispersed dyestuff was also incorporated into the bath to achieve 0.1 percent dyestuff based on fabric weight. The fabric exhibited improved opacity as with Example 1, and was dyed an even pink color. The fabric was subjected to repeated laundering and dry cleaning operations, and was durable both as to dye level and cover.

EXAMPLE 8

As mentioned above, it is known that titanium salts may be used in dispersions that are applied to textile materials, such as cellulose acetate, rayon and the like to deluster same. In such exhaustion techniques, which represent the closest prior art known to applicant at the time of filing of the application, the particle size of the titanium dioxide is generally 0.1 micron or smaller. Furthermore, the products of the present invention exhibit markedly improved physical characteristics as compared to products produced by such prior art exhaustion techniques, and Table III below illustrates the novel characteristics of the products of the present invention (see column 2) as compared to a control sample of the same fabric substrate to which no titanium dioxide particles have been applied (column 1). The same procedure was followed to prepare the sample illustrated in column 2 that is set forth in Example 1 except that the pigment used was Titanox 1070, an anatase product manufactured by NL Industries. A sample of the same fabric treated by a known exhaustion technique, namely Example 1 of U.S. Pat. No. 2,309,964 (herein the '964 patent), wherein the titanium dioxide particles of the same type used to prepare the sample of column 2 were exhausted from a bath containing aluminum formate is illustrated in column 3. Column 4 shows the physical characteristics of the same substrate treated by padding according to the process of Example 2 of the '964 patent. Column 5 provides the physical characteristics of the same substrate processed again according to Example 1 except that the bath contained aluminum sulfate rather than aluminum formate. In the Table the designation P stands for poor, F-G stands for fair to good, G stands for good, VG stands for very good, and E stands for excellent.

TABLE III

| Product Characteristics | Without Soil Release Finish: Control | Invention | 964 1 Aluminum Formate | 964 2 Padded | 964 1 Aluminum Sulfate |
|---|---|---|---|---|---|
| Cover | P | E | P | F-G | F |
| Durability of Cover | — | G | P | P | P |
| Hand | G | G | G | P | F-G |
| Moisture Transport | P | E | P | P | P |
| Crocking | — | VG | VG | P | P |
| Agglomeration | — | Slight | Medium | Heavy | Medium |
| Soil Hiding | P | G | P | F-G | F |
| % Exhaustion | — | 80 | 20 | — | 50 |

EXAMPLE 9

In this Example the same samples used in Example 8 and Table III were all padded according to the procedure set forth in Example 6 with a soil release emulsion containing a copolymer of methyl acrylate: acrylic acid (70:30), an ethoxylated polyester and a lubricant (ethoxylated oleic acid) to provide 0.3 percent copolymer solids, 0.15 percent ethoxylated polyester and 1.0 percent lubricant based on the fabric weight. The resulting properties of the textile materials are set forth below in Table IV:

TABLE IV

| | With Soil Release Finish: Control | "CUMULUS" | 964 1 Aluminum Formate | 964 2 Padded | 964 1 Aluminum Sulfate |
|---|---|---|---|---|---|
| Cover | P | E | P | F | F |
| Durability of Cover | — | G | P | P | P |
| Hand | G | G | G | P | F |
| Soil Release | G | G | G | G | G |
| Moisture Transport | G | E | G | G | G |
| Crocking | — | VG | VG | P | P |
| Agglomeration | — | Slight | Medium | Heavy | Medium |
| Soil Hiding | P | G | P | F-G | F |

EXAMPLE 10

Example 1 was repeated on a length of 100 percent spun polyester woven fabric instead of texturized polyester. The processed fabric exhibited greatly improved opacity (ΔL value of 9.1) when compared to a control fabric that was processed in like fashion without the presence of the titanium dioxide pigment (ΔL value of 18.3). Improved opacity remained after repeated launderings (ΔL value of 13.0 after 5 washings as compared to ΔL value of 18.2 for the control fabric).

EXAMPLE 11

Example 1 was repeated again on a length of 100 percent filament (untexturized) polyester woven fabric instead of the texturized polyester of Example 1. The processed fabric exhibited greatly improved opacity (ΔL value of 17.0) when compared to a control fabric that was processed in like fashion without the presence of titanium dioxide pigment (ΔL value of 28.5).

EXAMPLE 12

Example 1 was repeated once more on a length of nylon taffeta fabric instead of the 100 percent texturized polyester fabric of Example 1. While the processed fabric exhibited some improved opacity initially (ΔL value of 11.9) as compared to a control fabric that was processed in like fashion without the presence of titanium dioxide pigment (ΔL value of 24.5) after only 5 standard washings only about 8.7 percent of the particles initially present on the fabric remained.

EXAMPLE 13

Example 1 was repeated on a length of 100 percent woven acrylic fabric instead of the texturized polyester of Example 1. While the processed fabric exhibited some improved opacity initially (ΔL value of 3.2) as compared to the control fabric that was processed in a like fashion without the presence of titanium dioxide pigment (ΔL value of 15.0) after only 5 standard washings only about 25 percent of the particles initially present on the fabric remained.

EXAMPLE 14

Example 1 was repeated on a length of 65/35 polyester/cotton blend woven fabric instead of the 100 percent texturized polyester of Example 1. While the processed fabric exhibited some improved opacity initially (ΔL value of 6.2) as compared to a control sample that was processed in a like fashion without the presence of titanium dioxide pigment (ΔL value of 16.0) after only 5 standard washings only about 24 percent remained on the fabric. The ΔL value after 5 washings of the treated sample was 10.2, however, which compared favorably even against the initial opacity of the control sample.

That which is claimed is:

1. A process for improving opacity of a polyester fiber-containing textile material comprising the steps of:

(a) providing an aqueous dispersion of titanium dioxide pigment having a particle size of at least about 0.18 micron;

(b) contacting said textile material with said aqueous dispersion under agitation conditions and at a pH of less than about 7.5 whereby said titanium dioxide pigment exhausts from said dispersion; and (c) thereafter heat setting said material.

2. The process as defined in claim 1 wherein said dispersion pH during at least a portion of the time of contact with said material is in a range of from about 6 to about 3.

3. The process as defined in claim 1 wherein said dispersion pH during at least a portion of the time of contact with said material is in a range of from about 5 to about 4.

4. The process as defined in claim 1 wherein said dispersion is initially alkaline and pH is gradually reduced to a point below about 7.5.

5. The process as defined in claim 4 wherein said pH is reduced by including an acid generating compound in the dispersion and heating the dispersion for the generation of acid.

6. The process as defined in claim 4 where pH of the dispersion is reduced by the gradual addition of acid thereto.

7. A process for improving opacity of a polyester fiber-containing textile material comprising the steps of:

(a) providing an aqueous dispersion of titanium dioxide pigment having a particle size of at least about 0.18 micron, said dispersion having a pH above about 7.5;

(b) contacting said textile material with said aqueous dispersion under agitation conditions; and (c) gradually reducing pH of the dispersion to a level below approximately 7.5 whereby said pigment exhausts from said dispersion onto said textile material.

8. The process as defined in claim 7 wherein the process is carried out at ambient temperature and the pH is reduced by the gradual addition of an acid.

9. The process as defined in claim 7 wherein the dispersion further contains a heat activated acid generating compound, and the dispersion is gradually heated to generate acid and lower pH of the dispersion for exhaustion of the titanium dioxide pigment.

10. The process as defined in claim 7 wherein the initial pH of the dispersion is approximately 9, and the pH of the dispersion is gradually reduced to a pH in the range of from about 6 to about 3.

11. The process as defined in claim 10 wherein the dispersion contains, butyrolactone, and the dispersion is heated to a temperature of about 266° F., whereby acid is generated which gradually lowers the pH of the dispersion to about 4.7.

12. The process as defined in claim 7 comprising further heat setting the polyester textile material.

13. The process as defined in claim 12 wherein the textile material is heat set at a temperature in a range of from about 300° F. to about 400° F. for from about 5 seconds to about 2 minutes.

14. A process for improving opacity of a polyester fiber-containing textile material comprising the steps of:

(a) providing a binderless, aqueous dispersion comprising titanium dioxide pigment at a pH above approximately 7.5, said pigment having an average particle size of at least about 0.18 micron, and an acid generating substance;

(b) contacting said textile material with said dispersion and creating relative movement therebetween;

(c) gradually heating said dispersion with said textile material therein up to a temperature of approximately 266° F., at which point acid will have been generated adequate to lower pH of the dispersion within the range of about 6 to about 3, whereby substantially all the titanium dioxide pigment will exhaust onto the textile material; and (d) heat setting the textile material.

15. The process as defined in claim 14 wherein the acid generating substance is butyrolactone and the pH of the dispersion is lowered to about 4.7.

16. The process as defined in claim 14 wherein heat setting of the textile material is conducted at a temperature in the range of from about 300° F. to about 400° F. for a time period of from about 5 seconds to about 2 minutes.

* * * * *

UNITED STATES PATENT AND TRADEMARK OFFICE

CERTIFICATE OF CORRECTION

PATENT NO. : 4,420,507

DATED : December 13, 1983

INVENTOR(S) : Francis W. Marco

It is certified that error appears in the above-identified patent and that said Letters Patent is hereby corrected as shown below:

Column 9, line 23, delete "1" and insert therefor --2--.

Column 10, line 47, delete "the" and insert therefor --for--.

Column 14, line 42, delete "contains," and insert therefor --contains--.

Signed and Sealed this

*Nineteenth* Day of *March 1985*

[SEAL]

*Attest:*

DONALD J. QUIGG

*Attesting Officer* *Acting Commissioner of Patents and Trademarks*